US010184751B2

(12) United States Patent
Maeda

(10) Patent No.: US 10,184,751 B2
(45) Date of Patent: Jan. 22, 2019

(54) TOY GUN

(71) Applicant: MARUZEN COMPANY LIMITED, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 38 days.

(21) Appl. No.: 15/365,234

(22) Filed: Nov. 30, 2016

(65) Prior Publication Data

US 2017/0153082 A1 Jun. 1, 2017

(30) Foreign Application Priority Data

Nov. 30, 2015 (JP) ..... 2015-233827

(51) Int. Cl.

| | |
|---|---|
| ***F41B 11/00*** | (2013.01) |
| ***F41B 11/723*** | (2013.01) |
| ***F41B 11/62*** | (2013.01) |
| ***F41B 11/89*** | (2013.01) |
| ***F41B 11/73*** | (2013.01) |
| ***F41B 11/72*** | (2013.01) |

(52) U.S. Cl.

CPC ..... *F41B 11/723* (2013.01); *F41B 11/62* (2013.01); *F41B 11/72* (2013.01); *F41B 11/73* (2013.01); *F41B 11/89* (2013.01)

(58) Field of Classification Search

CPC ..... F41B 11/62; F41B 11/72; F41B 11/721; F41B 11/722; F41B 11/723

See application file for complete search history.

(56) References Cited

U.S. PATENT DOCUMENTS

| | | | | |
|---|---|---|---|---|
| 4,147,152 A | | 4/1979 | Fischer et al. | |
| 5,160,795 A | | 11/1992 | Milliman | |
| 5,711,286 A | * | 1/1998 | Petrosyan | F41B 11/55 124/53 |

(Continued)

FOREIGN PATENT DOCUMENTS

| | | |
|---|---|---|
| CN | 203642795 U | 6/2014 |
| FR | 2 847 765 A1 | 5/2004 |

(Continued)

OTHER PUBLICATIONS

IPO Search Report issued in Taiwan Patent Application No. 105139253, dated Jun. 30, 2017.

(Continued)

*Primary Examiner* — Gabriel J. Klein
(74) *Attorney, Agent, or Firm* — Michael Best & Friedrich LLP

(57) ABSTRACT

A valve body used in a shooting mechanism of an air gun includes a hollow valve body air chamber, a bottom portion of the chamber is detachably closed with a fit lid. A valve body cover is attached to the valve body. The valve body cover includes unit covers that are joined together. The unit covers include a lateral portion forming a part of the valve body cover and a joint. A unit cover bottom portion forms a part or all of the bottom portion of the valve body cover. When the valve body is housed in the unit covers, the unit covers are attached to the circumference of the valve body, and the bottom portion of the valve body cover is closed and may cover the lid.

17 Claims, 8 Drawing Sheets

(56) References Cited

U.S. PATENT DOCUMENTS

| | | | | |
|---|---|---|---|---|
| 6,314,954 | B1 * | 11/2001 | Wang | F41B 11/62 124/74 |
| 7,353,815 | B2 * | 4/2008 | Wei | F41B 11/56 124/45 |
| 8,261,728 | B1 * | 9/2012 | Tseng | F41B 11/55 124/73 |
| 2004/0200466 | A1 * | 10/2004 | Salva | F41B 11/56 124/74 |
| 2007/0028911 | A1 * | 2/2007 | Chen | F41B 11/56 124/74 |
| 2007/0181116 | A1 * | 8/2007 | Wei | F41B 11/723 124/74 |
| 2007/0272222 | A1 * | 11/2007 | Ho | F41B 11/723 124/73 |
| 2011/0017188 | A1 * | 1/2011 | Call | F41B 11/62 124/73 |
| 2015/0300771 | A1 * | 10/2015 | Tseng | F41B 11/62 124/74 |

FOREIGN PATENT DOCUMENTS

| | | | |
|---|---|---|---|
| TW | 415587 | U | 12/2000 |
| TW | M480666 | U | 6/2014 |

OTHER PUBLICATIONS

Extended Search Report issued in European Patent Application No. 16002527.6, dated Feb. 21, 2017.

* cited by examiner

TOY GUN

CROSS-REFERENCE TO RELATED APPLICATION(S)

This application is based upon and claims the benefit of priority from Japanese Patent Application JP2015-233827 filed on Nov. 30, 2015, the entire disclosure of which are incorporated herein by reference.

BACKGROUND OF THE INVENTION

Field of the Invention

The present invention relates to a toy gun. The present invention relates in particular to an air gun and in more particular to a valve body used in a shooting mechanism of an air gun.

Background Art

Valve bodies used in a shooting mechanism of an air gun must be airtight because high-pressure compressed gas as an energy source for firing bullets is filled therein without reducing the pressure. For this purpose, in conventional air guns, generally, the following measure is taken with respect to a valve body having a hollow valve body air chamber (space portion) therein: the rear end of the valve body is "threaded" and a lid is attached by screwing.

SUMMARY OF THE INVENTION

A valve body used in a shooting mechanism of an air gun includes a hollow valve body air chamber, a bottom portion of the chamber is detachably closed with a lid. A valve body cover is attached to the valve body. The valve body cover includes unit covers that are joined together. The unit covers include a lateral portion forming a part of the valve body cover and a joint. A unit cover bottom portion forms a part or all of the bottom portion of the valve body cover. When the valve body is housed in the unit covers, the unit covers are attached to the circumference of the valve body, and the bottom portion of the valve body cover is closed and may cover the lid.

The unit covers may respectively include integrated lateral portion and bottom portion. The valve body may be attached from left and right sides of the valve body. The valve body air chamber covers may be secured together with screws or may be integrated with puncture frames.

DETAILED DESCRIPTION OF THE EMBODIMENT

Figure 1:
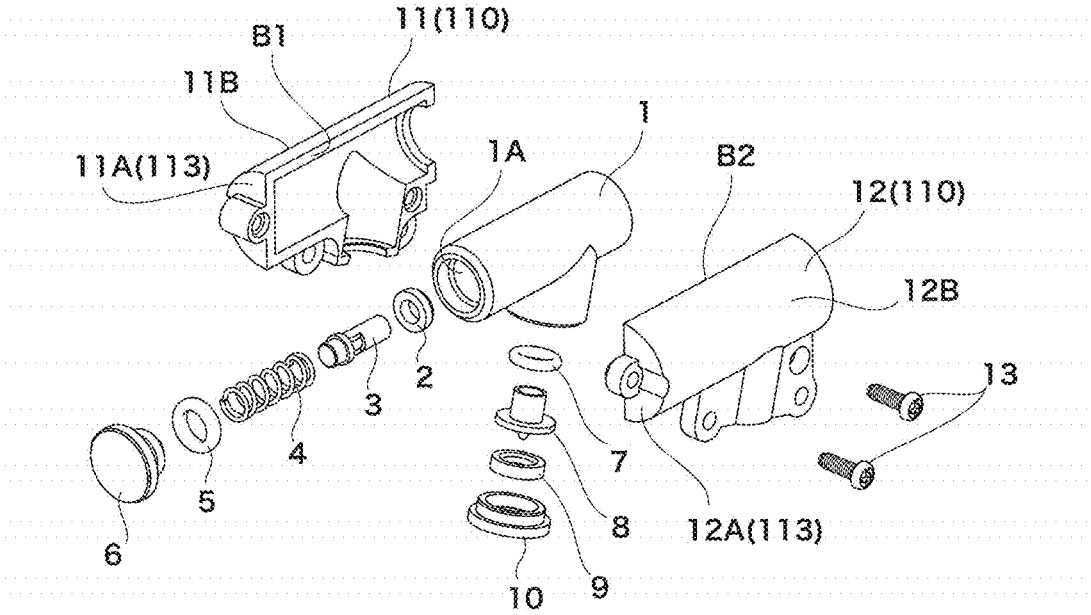
FIG. 1 is an exploded perspective view of a toy gun in a first example of an embodiment of the present invention.
Figure 2:
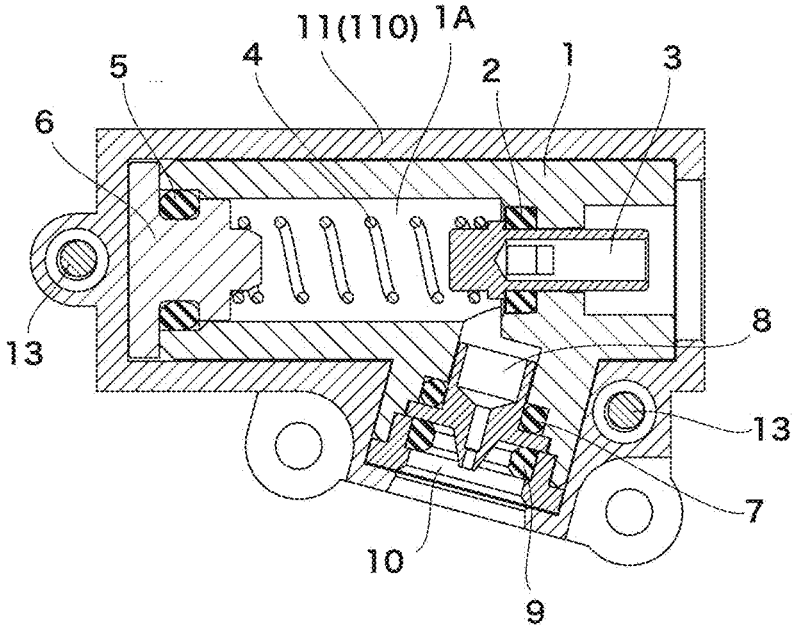
FIG. 2 is a partial enlarged sectional view of a toy gun in the first example of the embodiment of the present invention.
Figure 3:
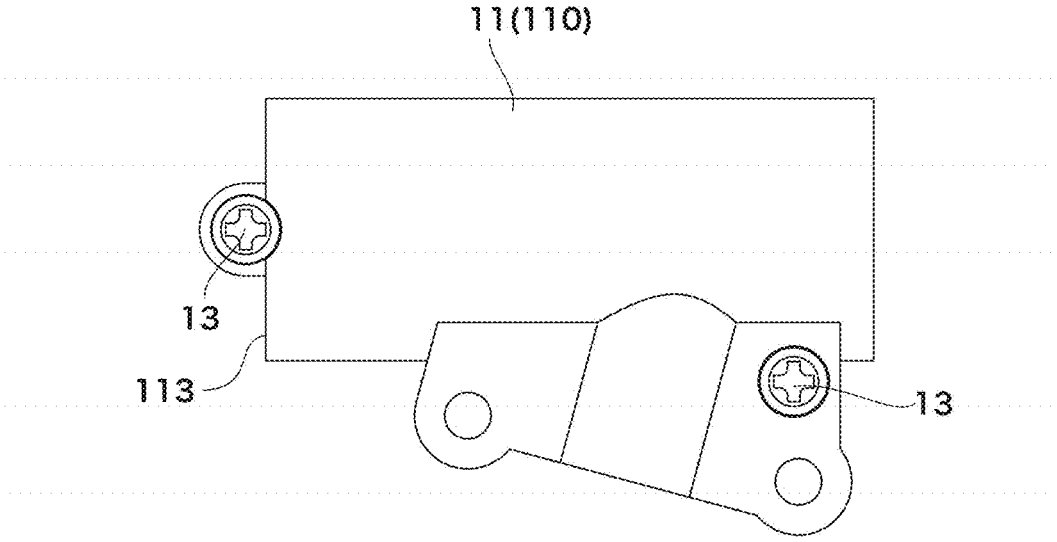
FIG. 3 is a partial enlarged front view of a toy gun in the first example of the embodiment of the present invention.

A description will be given to examples of an embodiment of the present invention with reference to the drawings depicting the examples of the present invention.

A description will be given with reference to FIG. 1 to FIG. 5 illustrating a first example of a toy gun A of the present invention. In this example, the toy gun A is comprised of an air gun which is actuated by air.

In the first example, valve body air chamber covers 11, 12 which are unit covers are separated from puncture frames 111, 121 which are integrated therewith in a second example.

Reference numeral 1 denotes a valve body. The valve body 1 is provided behind a chamber 27 located on the muzzle C side of the toy gun A. The valve body 1 includes a hollow valve body air chamber (space portion) 1A therein. In the valve body air chamber 1A, compressed gas can be enclosed and filled in an airtight state. "Airtight state" cited here refers to a state in which airtightness can be maintained against the pressure of air guided into the valve body air chamber 1A of the air gun.

Reference numeral 3 found in FIG. 1 to FIG. 5 and the like denotes a release valve. The release valve 3 is formed of a cylindrical body and is provided in the valve body air chamber 1A such that the release valve is movable frontward and rearward of the toy gun A.

Figure 4:
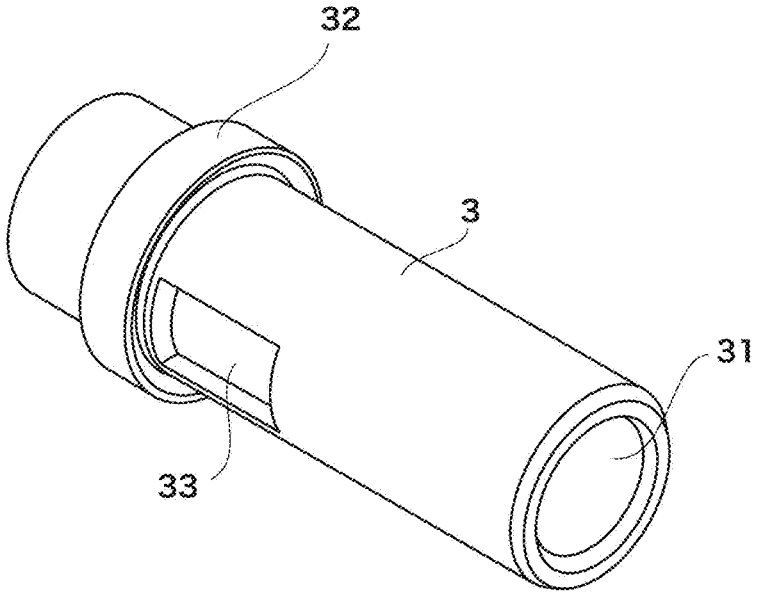
FIG. 4 is a partial enlarged perspective view of a toy gun in the first example of the embodiment of the present invention.
Figure 5:
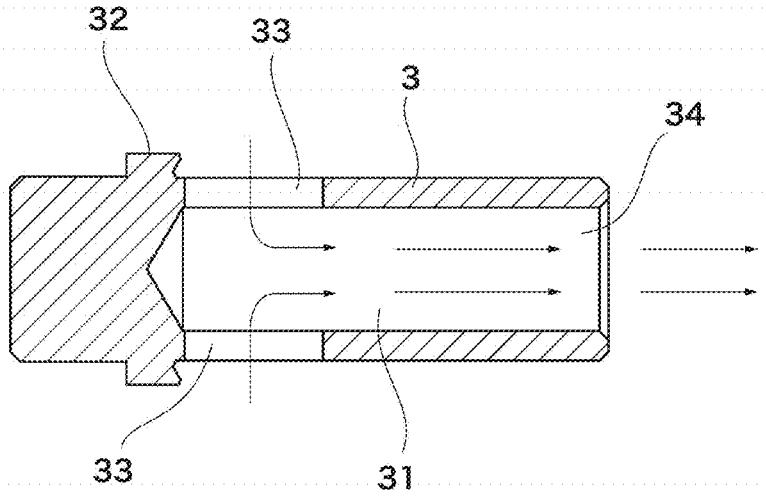
FIG. 5 is a partial enlarged sectional view of a toy gun in the first example of the embodiment of the present invention.

As illustrated in FIG. 4 and FIG. 5, the release valve 3 includes a valve through hole 31 therein and a flange portion 32 on the circumference thereof. Reference numeral 33 denotes a through hole opening. The through hole opening 33 is provided in a lateral portion of the release valve 3 and allows the outside of the release valve 3 and the through hole 31 to communicate with each other. For this reason, the release valve 3 guides gas from the through hole opening 33 into the through hole 31 and releases the gas from a tip opening 34 on the muzzle C side. The release valve 3 is provided on the circumferential surface thereof with a valve spring 4 which energizes the release valve 3 toward the muzzle C. As illustrated in the drawings, the flange portion 32 is larger in outside diameter than the other portions of the release valve 3. For this reason, with the release valve 3 energized toward the muzzle C by the valve spring 4, the flange portion is abutted against valve packing 2 provided on the front side of the valve body air chamber 1A; the interior of the valve body air chamber 1A is thereby kept airtight.

An air chamber lid 6 is fit to the valve body 1 on the rear end side. The air chamber lid 6 is provided, on the muzzle C side, with air chamber packing 5, which assists in maintaining airtightness. A conventional practice is to thread the rear end side of a valve body 1 and fit a similarly threaded air chamber lid thereto. This example obviates the necessity for threading.

Reference numeral 8 denotes a piercing member. The piercing member 8 is pointed. To be supplied with compressed gas in a gas cylinder 16 as an enclosed gas cartridge, the valve body 1 is provided thereunder with the piercing member 8 which is pointed to pierce the seal of the gas cylinder 16. Reference numeral 7 denotes piercing member packing and 10 denotes a piercing member lid. Provision of the piercing member packing 7 and the piercing member lid 10 prevents compressed gas from leaking out from the gas cylinder 16 as a gas cartridge. In conventional technologies, this area is also threaded and a piercing member and the like are provided. In this example, the piercing member lid 10 is fit into an opening and the necessity for threading is obviated.

As illustrated in FIG. 1, reference numeral 11 denotes a valve body air chamber cover left and 12 denotes a valve body air chamber cover right. Each of the valve body air chamber cover left 11 and the valve body air chamber cover right 12 is a unit cover and these covers constitute a valve body air chamber cover 110.

The valve body air chamber cover left 11 and the valve body air chamber cover right 12 respectively include integrally provided lateral portions 11B, 12B and bottom portions 11A, 12A. Reference numerals B1 and B2 denote respective joints of the valve body air chamber cover left 11 and the valve body air chamber cover right 12. The unit covers include the lateral portions 11B, 12B forming a part of the valve body air chamber cover 110 and the joints B1, B2. At least one of the unit covers includes the bottom portions 11A, 12A provided integrally with the lateral portions 11B, 12B and forming a part or all of a bottom portion 113 of the valve body air chamber cover 110. The bottom portion may be provided integrally with the lateral portion of only either unit cover.

That is, the valve body air chamber cover left 11 and the valve body air chamber cover right 12 are of half-cylinders obtained by dividing a cylinder having the bottom portions 11A, 12B into two at the joint B1 and the joint B2 in the longitudinal direction.

This example involves two unit covers but the number of unit covers may be three, four, or more.

When the valve body air chamber cover left 11 and the valve body air chamber cover right 12 are mated together at the joints B1, B2 and assembled, a cylinder with the bottom portion 113 closed is obtained. The valve body air chamber cover left 11 and the valve body air chamber cover right 12 fixed together in an airtight state are provided in the longitudinal direction with the joints B1, B2; therefore, the covers can be disassembled into multiple covers in the longitudinal direction.

The valve body 1 is sandwiched between the valve body air chamber cover left 11 and the valve body air chamber cover right 12 from both sides. The joint B1 and the joint B2 which are the respective joining end portions thereof are joined together and the valve body air chamber covers are fixed together with screws 13. As the result of this fixation, the press-fit air chamber lid 6 is prevented from being brought away from the valve body 1 even under gas pressure.

The valve body air chamber cover left 11 or the valve body air chamber cover right 12 does not have a threaded portion at the rear end portion thereof.

Figure 6:
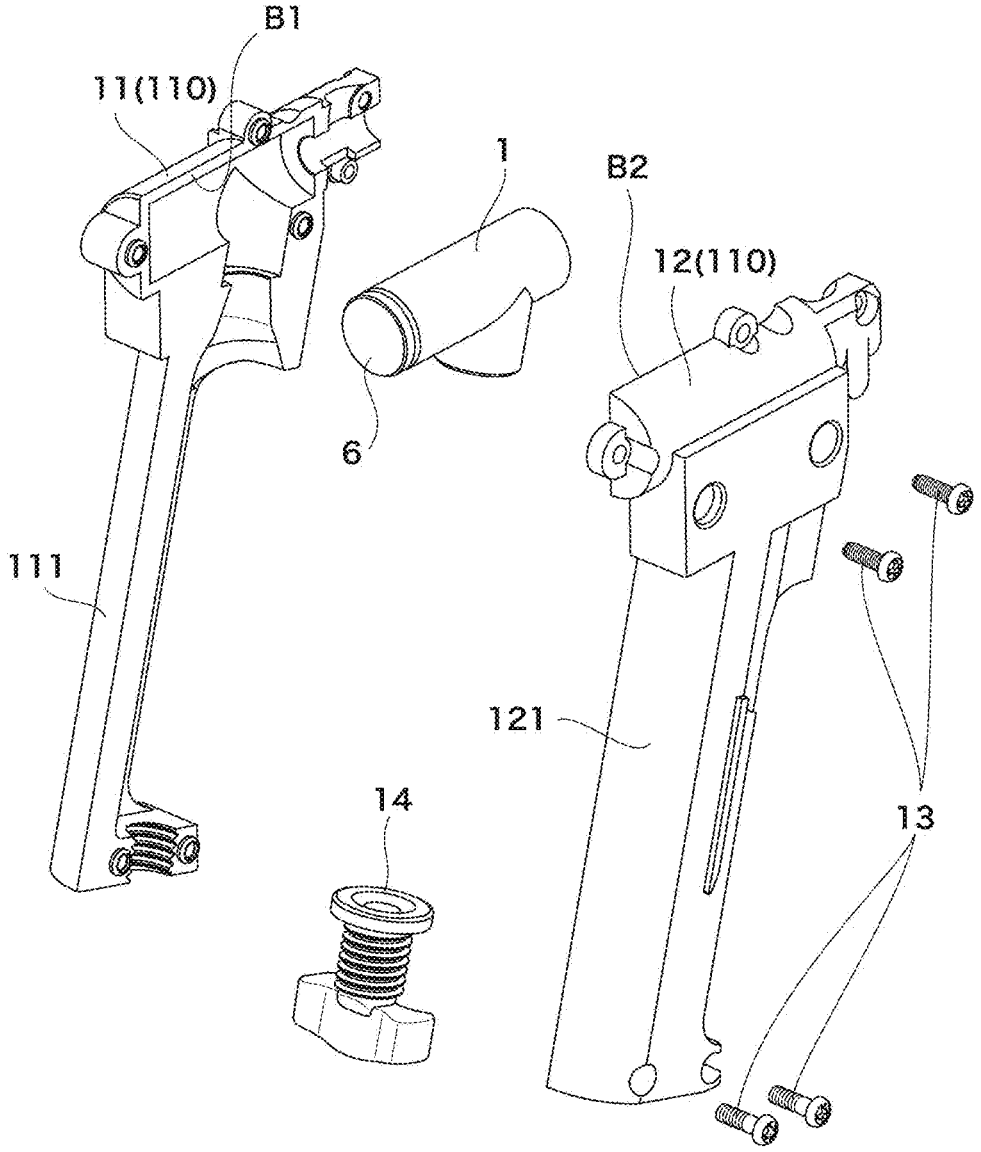
FIG. 6 is an exploded perspective view of a toy gun in a second example of the embodiment of the present invention.
Figure 7:
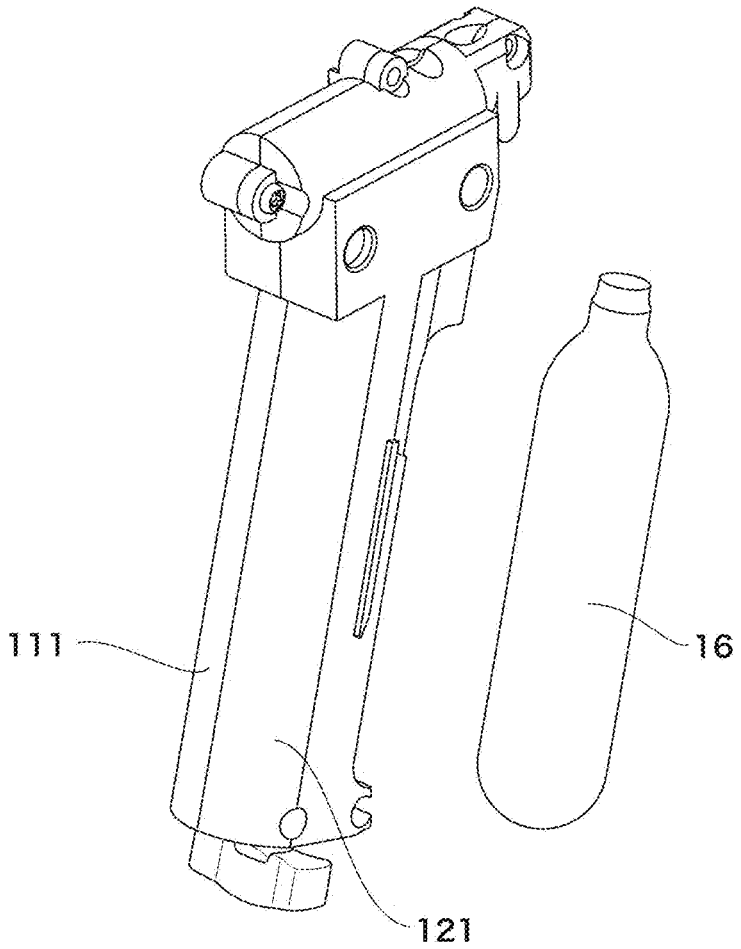
FIG. 7 is a perspective view of a toy gun in the second example of the embodiment of the present invention.

A description will be given to FIG. 6 and FIG. 7 illustrating a second example. In the second example, the valve body air chamber covers 11, 12 and puncture frames 111, 121 are integrated with each other.

The puncture frames are comprised of an air chamber unit A formed by housing the release valve 3 and the other above-mentioned parts in the valve body 1, the puncture frame left 111, the puncture frame right 121, a puncture screw 14, and the like. The puncture frames are cases for housing a gas cylinder 16 holding compressed gas as an energy source.

The valve body 1, the air chamber lid 6, and the like forming the air chamber unit are sandwiched between the puncture frame left 111 and the puncture frame right 121 from both sides and secured with screws 13. The puncture screw 14 is placed at the lower parts of the puncture frame left 111 and the puncture frame right 121 and is sandwiched between the puncture frame left 111 and the puncture frame right 121 from both sides and is thereby secured. The puncture frame left 111 and the puncture frame right 121 also function as the respective valve body air chamber cover left 11 and valve body air chamber cover right 12 thereof.

Figure 8:
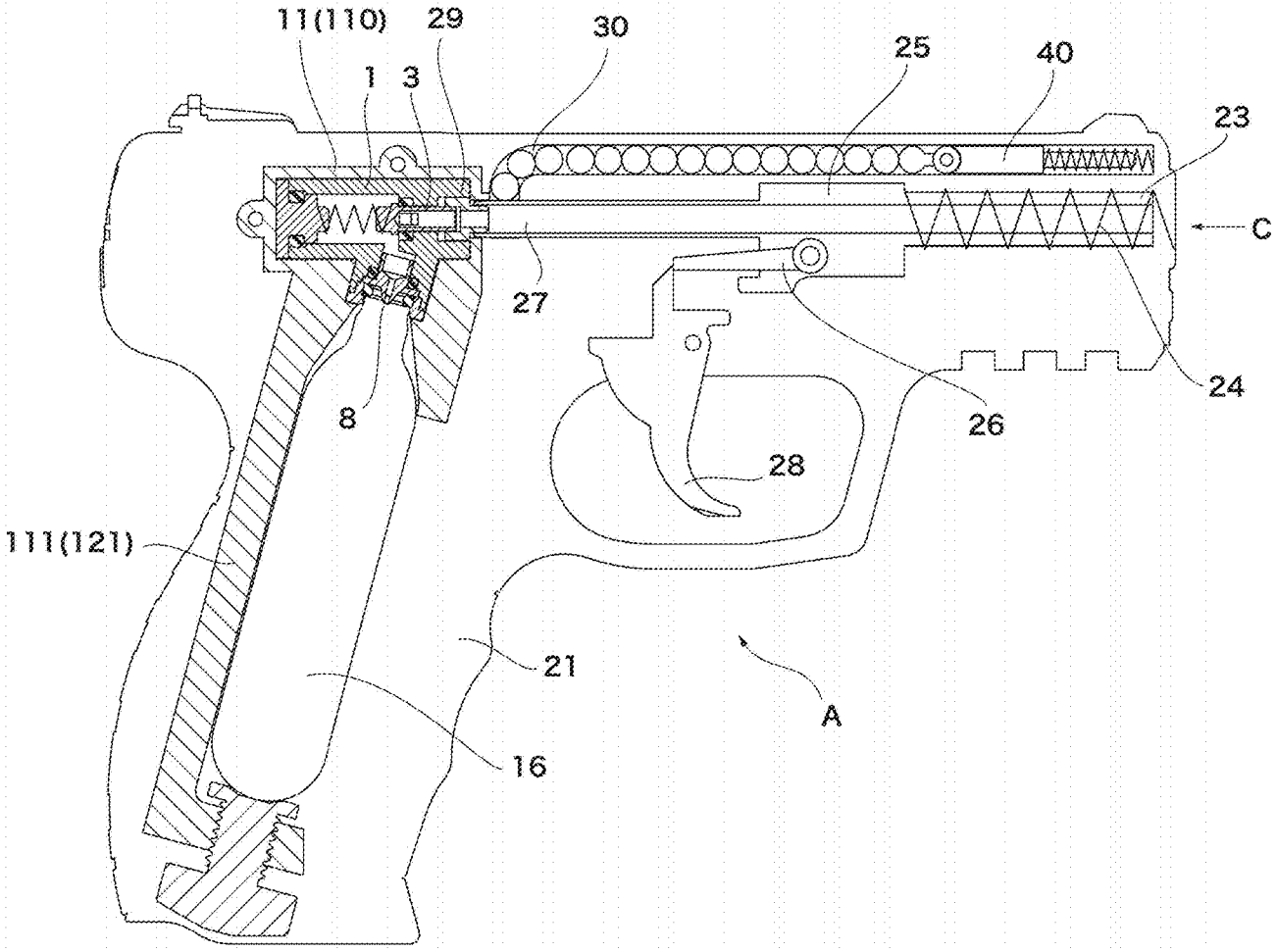
FIG. 8 is a front view of a toy gun in the second example of the embodiment of the present invention as is used.

A description will be given to the action of the second example before a bullet is fired with reference to FIG. 8 to FIG. 9.

A gun main body 21 is mainly comprised of the puncture frames (puncture frame left 111 and puncture frame right 121), an inner barrel 23, a barrel housing 25, a trigger 28, a hit pin 29, a magazine 30, and the like.

The inner barrel 23 is provided with a barrel spring 24 and the inner barrel 23 is energized toward the rear end of the gun. The barrel housing 25 is provided with a barrel latch 26.

The trigger 28 is provided such that the trigger is rotatable around a trigger shaft. The tip of the upper part of the trigger 28 is engaged with the barrel latch 26. The barrel latch 26 is provided such that the barrel latch is rotatable around a barrel latch shaft.

The hit pin 29 is provided at the rear end of the inner barrel 23. A chamber 27 for receiving a bullet W falling down from the magazine 30 is provided on the muzzle C side of the hit pin 29.

In this example, the magazine 30 is provided above the inner barrel 23 but the magazine 30 may be provided anywhere as long as bullets W can be supplied. The bullets W in the magazine 30 are moved into the chamber 27 by a magazine follower 40 each time one bullet is fired.

Figure 9:
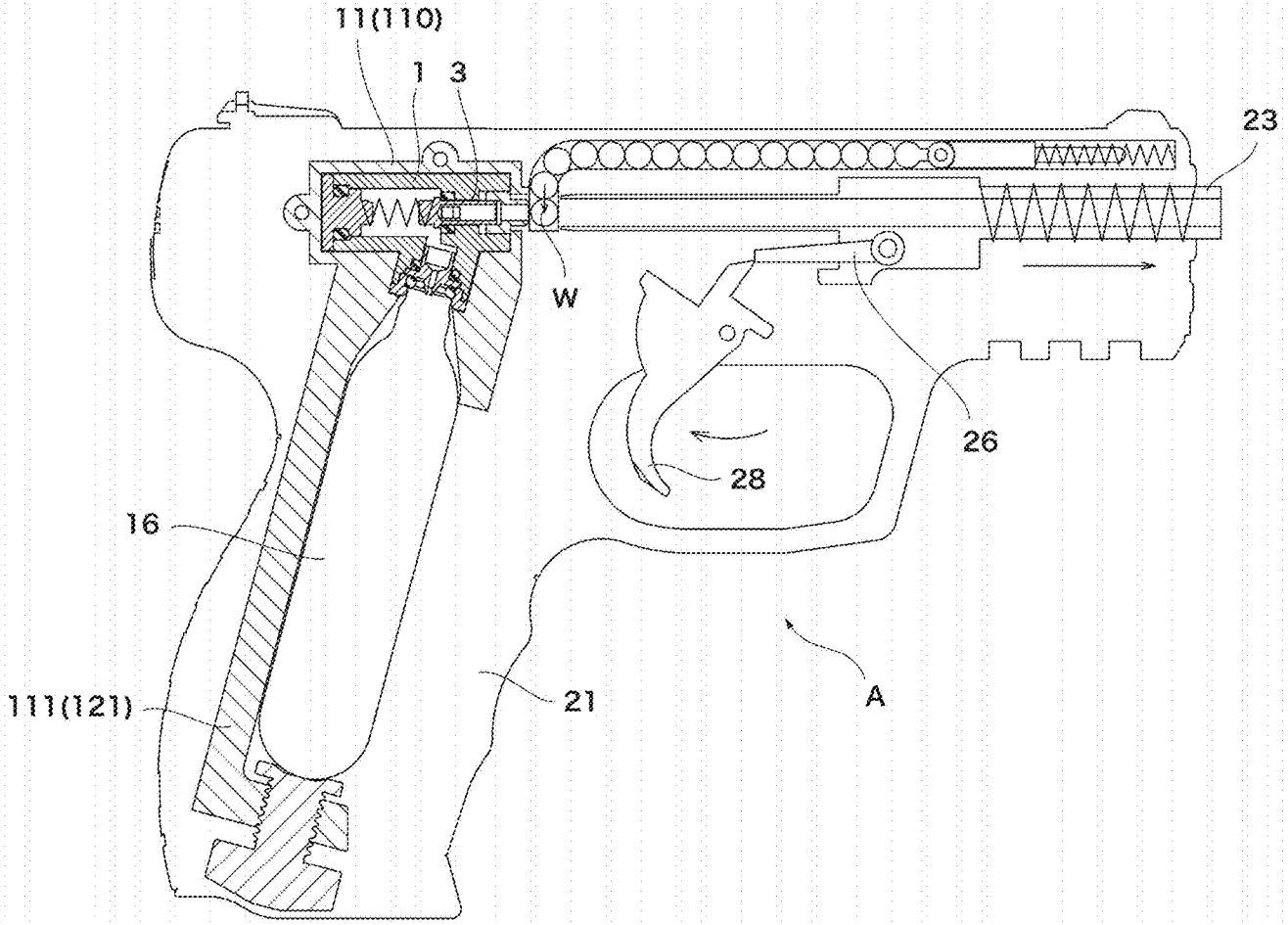
FIG. 9 is a front view of a toy gun in the second example of the embodiment of the present invention as is used.

When a user pulls the trigger 28, as illustrated in FIG. 9, the tip of the upper part of the trigger 28 presses the inner barrel 23 forward in engagement with the barrel latch 26. As the result of the advance of the inner barrel 23, one bullet W falls down from the magazine 30 and is loaded.

Figure 10:
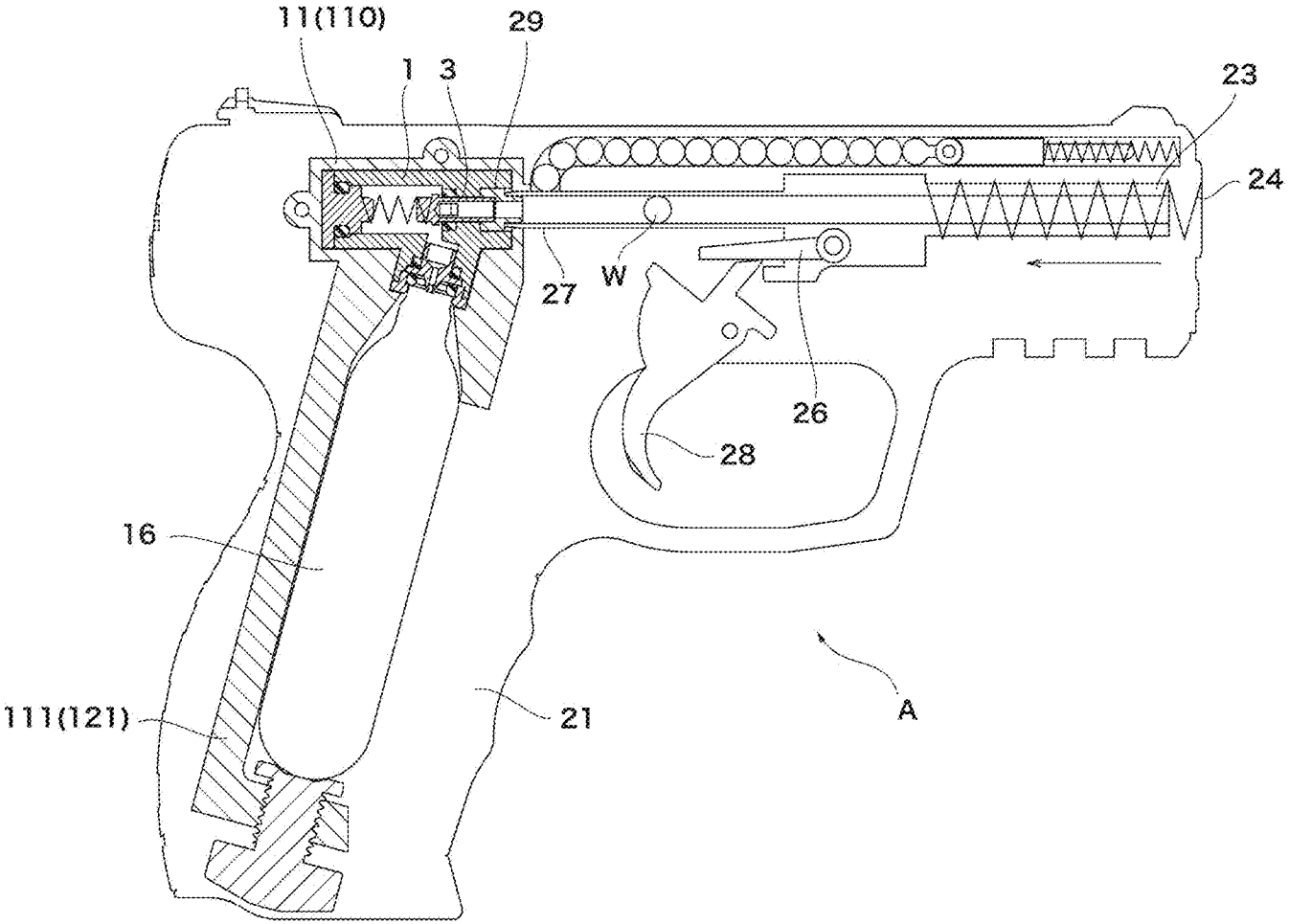
FIG. 10 is a front view of a toy gun in the second example of the embodiment of the present invention as is used.

When the trigger 28 is subsequently disengaged from the barrel latch 26, as illustrated in FIG. 10, the inner barrel 23 is energized by the barrel spring 24 and swiftly retreated. The rear end of the inner barrel 23 directly hits the hit pin 29 provided ahead of the release valve 3 (muzzle C side). When the hit pin 29 is moved toward the rear end of the gun and collides with the release valve 3, the release valve 3 is retreated. As the result, the opening provided in the release valve 3 is exposed in the valve body air chamber and compressed gas flows in and airtightness is lost. The compressed gas goes through the through hole in the release valve 3 and presses a bullet W in the chamber 27 hard. The bullet W goes through the cavity in the inner barrel 23 and is fired out of the gun main body 21.

This example is comprised of a toy gun A which does not involve blowback but it is theoretically applicable to a toy gun A involving blowback.

What is claimed is:

1. A toy gun comprising:

a valve body including a hollow valve body air chamber, an end portion of the chamber is detachably closed with a lid, the lid being non-threadably fitted to an end of the valve body, a portion of the lid being secured within the valve body air chamber; and a valve body cover attached to the valve body, the valve body cover including unit covers that are joined together;

wherein each of the unit covers includes a lateral portion forming a part of the valve body cover and a joint, at least one of the unit covers includes a unit cover bottom portion that forms a part or all of a bottom portion of the valve body cover that is integrally provided on the lateral portion, and wherein, when the valve body is housed in the unit covers, the unit covers are attached to a circumference of the valve body, the joints of the unit covers are joined together thereby forming the valve body cover, and a bottom portion of the valve body cover is closed.

2. The toy gun according to claim 1, wherein the unit covers respectively include an integrated lateral portion and bottom portion.

3. The toy gun according to claim 1, wherein the unit covers are attached from left and right sides of the valve body.

4. The toy gun according to claim 2, wherein the unit covers are attached from left and right sides of the valve body.

5. The toy gun according to claim 1, wherein the unit covers are secured together with screws.

6. The toy gun according to claim 2, wherein the unit covers are secured together with screws.

7. The toy gun according to claim 3, wherein the unit covers are secured together with screws.

8. The toy gun according to claim 4, wherein the unit covers are secured together with screws.

9. The toy gun according to claim 1, wherein the unit covers are integrated with puncture frames.

10. The toy gun according to claim 2, wherein the unit covers are integrated with puncture frames.

11. The toy gun according to claim 3, wherein the unit covers are integrated with puncture frames.

12. The toy gun according to claim 4, wherein the unit covers are integrated with puncture frames.

13. The toy gun according to claim 5, wherein the unit covers are integrated with puncture frames.

14. The toy gun according to claim 6, wherein the unit covers are integrated with puncture frames.

15. The toy gun according to claim 7, wherein the unit covers are integrated with puncture frames.

16. The toy gun according to claim 8, wherein the unit covers are integrated with puncture frames.

17. The toy gun according to claim 1, wherein the bottom portion of the valve body cover covers the lid.

* * * * *